US005551224A

United States Patent [19]

Kumpf et al.

[11] Patent Number: 5,551,224

[45] Date of Patent: Sep. 3, 1996

[54] DEVICE FOR REVERSE-TWISTING STRANDING ELEMENTS

[75] Inventors: Friedhelm Kumpf, Pulheim; Peter Haberberger, Nürnberg, both of Germany

[73] Assignee: FRISCH Kabel-und Verseilmaschinenbau GmbH, Ratingen, Germany

[21] Appl. No.: 418,061

[22] Filed: Apr. 6, 1995

[30] Foreign Application Priority Data

Apr. 6, 1994 [DE] Germany ..... 44 11 506.7

[51] Int. Cl.[6] ..... D01N 5/00; D01H 7/46

[52] U.S. Cl. ..... 57/293; 57/294; 57/311; 57/314; 57/352

[58] Field of Search ..... 57/352, 6, 7, 9, 57/293, 294, 311, 314

[56] References Cited

U.S. PATENT DOCUMENTS

| | | | |
|---|---|---|---|
| 2,881,582 | 4/1959 | Robbins | 57/2.3 X |
| 3,732,682 | 5/1973 | Crotty et al. | 57/314 |
| 3,847,190 | 11/1974 | Forester | 57/293 |
| 4,056,925 | 11/1977 | Vogelsberg | 57/293 |
| 4,207,928 | 6/1980 | Pershin et al. | 57/294 X |
| 4,214,430 | 7/1980 | Vogelsberg et al. | 57/294 X |
| 4,224,788 | 9/1980 | Vogelsberg | 57/294 |
| 4,339,913 | 7/1982 | Vogelsberg | 57/294 |
| 4,365,469 | 12/1982 | Vogelsberg | 57/293 |
| 4,429,520 | 2/1984 | Garner et al. | 57/293 |
| 4,429,521 | 2/1984 | Oestreich | 57/294 |
| 4,432,199 | 2/1984 | Dzyck et al. | 57/294 |
| 4,586,327 | 5/1986 | Oestreich | 57/293 X |
| 4,974,408 | 12/1990 | Karhu | 57/293 |

FOREIGN PATENT DOCUMENTS

| | | | |
|---|---|---|---|
| 2412514 | 9/1975 | Germany | 57/294 |
| 2262705 | 6/1977 | Germany . | |
| 3404264 | 8/1985 | Germany | 57/293 |

*Primary Examiner*—William Stryjewski
*Attorney, Agent, or Firm*—Ware, Fressola, Van Der Sluys & Adolphson

[57] ABSTRACT

A device for the reverse-twisting of stranding elements (4), comprising a stationary guide disk (1) and a twisting disk (2) located at a distance from the guide disk and able to rotate around its axis. At least one filament-shaped, tension-proof support element (7) is located between the guide disk (1) and the twisting disk (2). At least one holding element (5) is mounted on the support element (7) and is located at a distance from the guide disk (1) on one side, and from the twisting disk (2) on the other. The holding element (5) contains axial passage holes (6) for the stranding elements (4). The ends of the support elements (7) are affixed in holders (9), which are able to tilt and/or rotate with respect to the twisting disk (2).

24 Claims, 3 Drawing Sheets

DEVICE FOR REVERSE-TWISTING STRANDING ELEMENTS

BACKGROUND OF THE INVENTION

1. Field of the Invention

The present invention relates to a device for the reverse-twisting of stranding elements.

2. Description of the Prior Art

The term "stranding elements" as used in the sense of the invention refers to individual elements which make up the cores of cables. The elements may be optical, electrical, or any other kind of conductors which make up the cores of optical, electrical or other type of cable. Stranding elements can also be elements of a higher order, which already encompass several individual stranding elements. Higher order elements are for example pairs, fours, bundles, etc. The stranding elements can also be plastic filaments or bare metal wires which are used as the concentric protective conductors of power line cables or to shield high-voltage cables or telecommunication cables, for example.

During stranding of stranding elements, reverse-twisting, which periodically changes the twist direction of the stranding elements, provides advantages over stranding processes wherein the twist direction remains the same. For example, if reverse-twisting is not used, a rotating spool discharge for the stranding elements is needed, which only allows the stranding elements to be manufactured in limited lengths. In contrast, reverse-twisting offers the possibility of continuous manufacture of the stranding elements at high discharge speeds.

One device which is particularly well-suited for reverse-twisting of stranding elements is disclosed in German document DE-OS 42 26 514, wherein the stranding elements are subjected to extremely low friction during the twisting process, in contrast to another known device disclosed in German document DE-AS 22 62 705. The advantages provided by the device disclosed in German document DE-OS 42 26 514 are provided by using holding elements, preferably holding disks, which have a low mass, so that no significant additional masses must be moved during the twisting of the stranding elements, even when a large number of such holding disks are used. Because of the low rotational moment of inertia of the holding disks, the reversing times of the stranding can be kept very short. Contamination of the holding disks or their passage holes is eliminated, dust particles or water scale (from cooling water) cannot be deposited on the holding disks, in contrast to known guide hoses used in other prior art devices. The stranding conditions provided by the device disclosed in German document DE-OS 42 26 514 can therefore be considered constant.

SUMMARY OF THE INVENTION

An object of the invention is an improved stranding device having increased production speeds and an extended service life so that the continuous manufacture of even longer lengths of cable can be performed without any disruption.

It has been found that the foregoing object can be readily attained by attaching the ends of support elements, which are used to support holding elements, to holders which are able to tilt and/or rotate with respect to a twisting disk. The torsion and bending of the support elements caused by the constant back and forth rotation of the twisting disk can be reduced without fear of damage to the ends of the support elements. Any breaking or tearing of the support elements, even after a long period of operation, is avoided.

To carry out the invention, the holders at the ends of the support elements are arranged so that they tilt vertically and horizontally. This is accomplished with known universal joints which support the holders. The operational reliability, especially the service life of the stranding device according to the invention, can be even further improved if the holders at the ends of the support elements have axial and radial bearings. The rotating movement obtained in this manner makes it possible to safely reduce the torsion stresses in the support elements.

The operational reliability of the stranding device according to the invention is further promoted if the ends of the support elements are bent inside the holders, and are then clamped inside the holders in this bent condition. As is known in the art, the service life of prior art stranding devices is basically dependent on the service life of the support elements used to support the holding elements, and is particularly dependent on the service life of the support element ends or on the attachment of support element ends. In addition to the described manner of mounting of the ends of the support elements according to the invention, it is advantageous to use cables comprising a number of twisted or bunched individual metal wires which, as explained, are clamped without abrasion at their ends. This special configuration provides for an extended service life of the stranding device of the invention, particularly if higher production speeds are used.

Because of the constant change in the direction of rotation of the stranding device and the respective increase in bending and torsion stresses of the support elements, it is especially important to avoid surface damage of the support elements, which in practice can lead to breaking or tearing of the support elements, due to the sequential notch effect, after such continuous stressful operation. It has proven to be especially advantageous in this connection if the metal cables are plastic coated, for example with a plastic that is highly abrasion resistant. Preferably, the metal cables are coated in a way so that the plastic coating penetrates from the outside into the spaces within the individual wires to thereby provide additional bonding inside the stranded metal cable structure.

The path between a stationary guide disk and the rotating twisting disk is a so-called storage path, in which the stranding elements are securely guided by the holding elements. To ensure uniform stranding during continuous operation, the distances between the individual holding elements are different. For example, starting from the ends on both sides of the support elements, the distances between the holding elements increase toward the center. To maintain these distances, which are selected to meet the respective requirements expected from the end product, separating tubes are received over the support elements between the holding elements, and over the ends of the support elements between holding elements and the holders. The separating tubes may be made of wound steel wires with an external protective sheath, at least in the area next to the holders at the ends of the support elements. Such separating tubes, constructed similar to so-called Bowden tension casings, are able to securely maintain the desired separation between the holding elements, particularly in the end areas of the support elements. Additionally, the separation tubes protect the support elements against any outside mechanical stresses that could damage the surface, and at the ends of the support elements which are inserted into the holders, the separating tubes serve as protection against buckling of the support elements.

Separate spacer rings, with guide bores distributed around their circumference, are provided to separate the support elements from one another. The wall thickness of these spacer rings may be provided with an additional reinforcement in the area of the guide bores. The spacer rings for the support elements are more cost-effective to manufacture than the holding elements, and are lighter in weight and have a lower mass, and therefore moment of inertia, than the holding elements. Since the stranding elements pass freely through the spacer rings, there are no abrasion problems in the area of these spacer rings, thus abrasion of the stranding elements is avoided. For this reason, it has proven to be particularly advantageous if 60% to 80% of the holding elements are replaced by a corresponding number of spacer rings, as compared to prior art stranding devices.

As already explained, a special advantage of a known holding element lies in the fact that, because of low friction, the passing stranding elements are not contaminated, or worse clogged, by dirt particles that are carried along with the stranding elements, nor by residues from cooling water applied to the holding elements. However, the boundary surfaces of guide holes in the holding elements form friction surfaces, which may produce some wear. In order to adapt the service life of the guide holes to that of the entire device, it has proven to be advantageous for the holding elements to be disks made of an abrasion-proof material. For example, the holding elements may be made of a highly abrasion-resistant plastic with incorporated sliding means to reduce friction. Alternatively, the holding elements may be ceramic, for example on an aluminum-oxide basis. The holding elements are provided with a number of holes that corresponds to the maximum number of stranding elements required on a regular basis. This allows the set-up time for manufacturing stranded elements with a different number of individual elements to be considerably shortened.

To make a continuous stranding process possible, the tension-proof support elements between the guide disk and the twisting disk must be able to be tightened in response to the change in the length of the storage path resulting from the rotation of the twisting disk to thereby maintain tension in the support elements. A pneumatic tension system with linear compressed air cylinders has proven to be useful for the purpose of maintaining tension in the support elements. Each of the support element holders on the guide disk side are attached to a linear guide of a linear compressed air cylinder unit. Since corresponding forces are exerted on the support elements from a repeated rotation of the stranding device in one and then in the other direction, it is important to provide continuous equalization of the axially directed tensile forces during operation, as described above. The tension system is implemented by individually attaching each support element holder to a respective linear guide. Next, prior to the start of the stranding process, the holding elements are pretensioned in accordance with the rhythm of the twisting motion. During the stranding process, the holders at the guide disk side of the support elements are for example guided back and forth in the axial direction on the linear guides.

Instead of several linear compressed air cylinders, a correspondingly positioned deflection pulley can be used to equalize the lengths and the forces between the support elements. Using this alternative configuration, the support elements are not individually attached at the end on the guide disk side, but instead endlessly pass over the deflection pulleys, so that no difference in length between the support elements can occur.

The foregoing and other objects, features and advantages of the present invention will become more apparent in light of the following detailed description of exemplary embodiments thereof, as illustrated in the accompanying drawings.

DETAILED DESCRIPTION OF THE INVENTION

Figure 1:
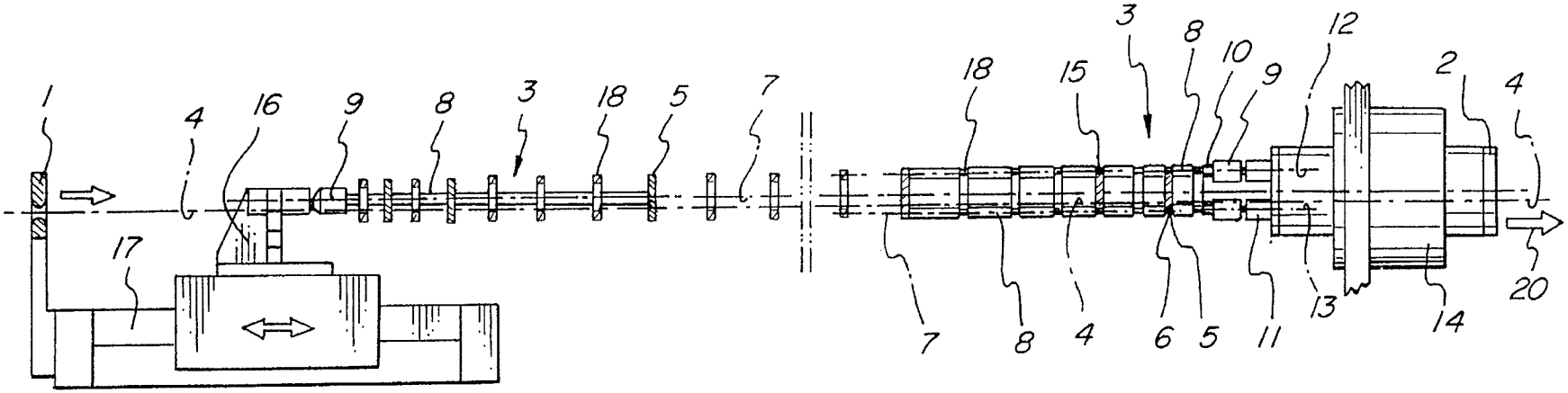
FIG. 1 is a side view of the stranding device of the present invention rotated by 90 degrees for better viewing.

As depicted in FIG. 1, between a stationary guide disk 1 and an alternately rotating twisting disk 2 is a storage path 3, in which stranding elements 4 are twisted in the direction of rotation of the twisting disk 2. The direction of rotation of the twisting disk 2 changes during movement of the stranding elements 4 through the storage path 3, and the stranding elements 4 then move out of that storage path 3. The stranding elements 4 are drawn from stationary stores (not shown). To guide the stranding elements 4, of which only one is illustrated for reasons of clarity, holding elements 5 are used, which are spaced along the storage path 3 and are equipped with guide holes 6 for the passage of the stranding elements 4. The holding elements 5 of the illustrated configuration example are disks. The disks have, for example, a central guide hole 6 with a core inlet, and further guide holes distributed around the circumference for the stranding elements that will be twisted about a central core (not shown).

The holding elements 5 are mounted on tension-proof support elements 7, and the support elements 7 are held in position by separated spacer rings 18. Because, as compared to the holding elements 5, the spacer rings 18 have a simpler construction, lower mass moment of inertia, and provide for the free passage of the stranding elements 4 through an inside of the spacer rings 18, it is useful to choose the number of spacer rings 18 along the storage path 3 to be as high as possible. Preferably, for example, 60% to 80% of the number of holding elements used in the prior art for a specified length of the storage path 3 can be replaced by the spacer rings 18 of the invention.

The support elements 7 are plastic coated, highly flexible steel cables for example, and small plastic tubes 8 are used to both affix the holding elements 5 to these support elements 7 and to separate the holding elements 5 from one another. As can easily be seen in FIG. 1, these small tubes 8 are of different lengths, so that the distances between the individual holding elements 5 are different as well. It has proven to be advantageous to let the distances between each pair of holding elements 5 increases toward the center of the storage path 3, starting from the stationary guide disk 1 and from the rotating twisting disk 2. An advantageous configuration of the invention starts, for example, with a first space of about 10 mm between the holding elements 5 adjacent to the holders 9 on the ends of the support elements 7, which increases in steps of 5 mm each, up to 55 mm in the center of the storage path.

According to the invention, both ends of the support elements 7 are supported by holders 9 which allow the ends to tilt and/or rotate. The ends of the support elements 7 are inserted and clamped tightly in the holders 9. As protection against buckling, the last small tube 10 adjacent to each end of the support elements 7 is made of wound steel wire with an external plastic coating, such that the small tube 10 is itself flexible and follows the movements of the support element 7 without any problems. The small tubes 10 helps to prevent damage to the ends of the support elements 7 caused by buckling or damage from external influences, perhaps during clamping due to an installation error. Each holder 9 is able to tilt vertically and horizontally from the illustrated position because of the presence of a universal joint 11. Additionally, the holders 9 are able to rotate because of the presence of an axial bearing 12 and a radial bearing 13, so that torsional stresses occurring during the twisting of the two support elements 7 during the stranding process are equalized and need not to be caught by the support elements 7 themselves.

The rotating twisting disk 2 can be driven to rotate inside a housing 14. After the stranding elements 4 pass in the direction of the arrow 20, they are combined into the twisted strand in an adjacent twisting point (not shown).

The stationary perforated disk 1 is located at the other end of the storage path 3. The holder 16 has the ability of moving back and forth in an axial direction as illustrated by the double headed arrow in FIGS. 1 and 2, so that the prestressing of the support elements 7 can be adapted during the stranding process to the momentary operating condition of the storage path 3. A pneumatic system 17 having linear compressed air cylinders is used to maintain the tension in the support elements 7 in the axial direction. The holders 16 are interconnected to the air cylinders, and the air cylinders act as linear guides to control the linear movement of the holders 16 in the axial direction. Another advantage of this stressing system lies in the relatively low mass linear guidance, which is integrated into the compressed air cylinder, thus further reducing the mass inertia of the parts to be moved.

Figure 2:
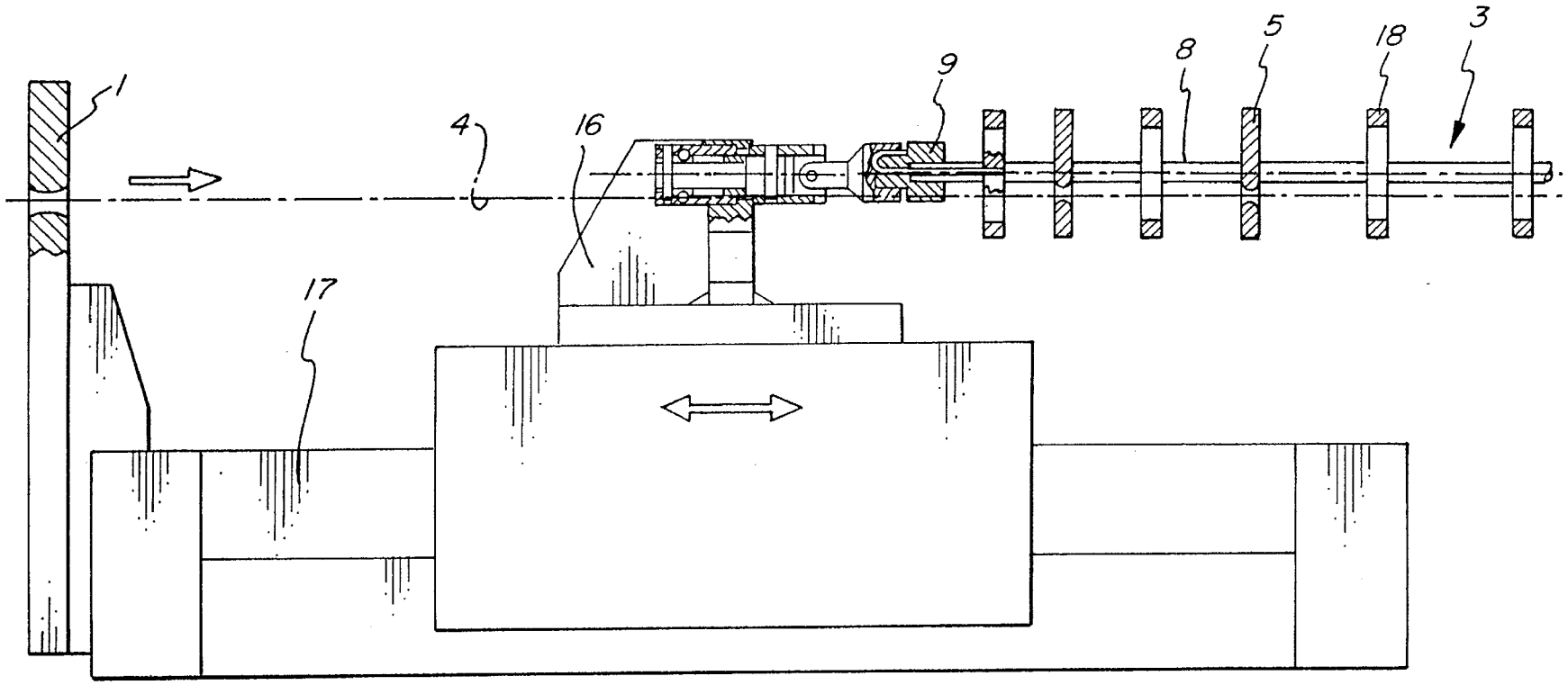
FIG. 2 is an enlarged side view of the stranding device of FIG. 1, in the area of a stationary guide disk.

FIG. 2 shows an enlarged view of the stranding device of FIG. 1 in the area of the stationary guide disk 1 and the holder 16.

Figure 3:
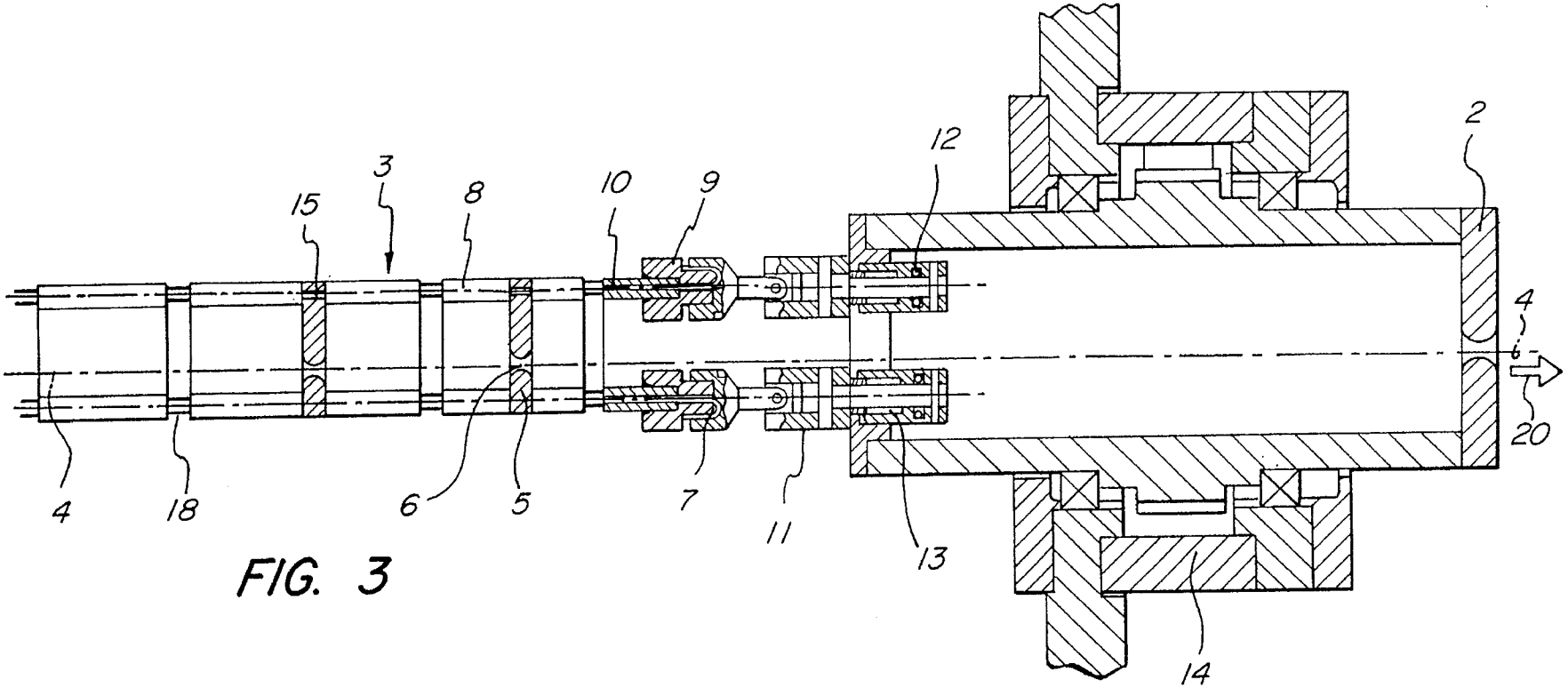
FIG. 3 is an enlarged side view of the stranding device of FIG. 1, in the area of a twisting disk.

Finally, FIG. 3 shows an enlarged view of the stranding device of FIG. 1 in the area of the twisting disk 2 rotating in the housing 14. As mentioned above, the axial bearing 12 and the radial bearing 13 allow the holders 9 to rotate, and the universal joint 11 allows the holders 9 to tilt vertically and horizontally. As can be seen in FIG. 3, the support elements 7 are furthermore inserted into the holders 9, where they are bent and clamped tight from the outside with a set screw. As can be seen, the small tube 10, already mentioned as protection against buckling, is inserted into the holder 9, where it simultaneously secures the adjustable distance to the first holding element 5. The holding elements 5 contain both guide holes 6 for the stranding elements 4, and passage holes 15 for the support elements 7. Other small tubes 8, made for example of a pressure-resistant, flexible plastic, affix the individual holding element 5 to the support elements 7, where, in addition to the adjustable spacing, they also provide the advantage of preventing damage to the support elements caused by the stranding elements that pass during the twisting process.

Although the invention has been described and illustrated with respect to exemplary embodiments thereof, the foregoing and various other additions and omissions may be made therein and thereto without departing from the spirit and scope of the present invention.

What is claimed is:

1. A device for the reverse-twisting of stranding elements, comprising:

a stationary guide disk;

a twisting disk, located at a distance from said guide disk, which is able to rotate around its axis;

said guide disk and said twisting disk each containing first axial passage apertures for guiding the stranding elements;

at least one filament-shaped, tension-proof support elements located between said guide disk and said twisting disk;

at least one holding element mounted to said at least one support element, said at least one holding element being located at a distance from said guide disk and said twisting, said at least one holding element containing second axial passage apertures for receiving the stranding elements therethrough; and holders wherein the ends of the support elements are attached, said holders being able to tilt and rotate with respect to said twisting disk.

2. A device as claimed in claim 1, wherein said holders are able to tilt in a vertical and horizontal direction.

3. A device as claimed in claim 2, further comprising universal joints for mounting said holders.

4. A device as claimed in claim 3, further comprising axial and radial bearings for mounting said holders.

5. A device as claimed in claim 4, wherein ends of said at least one support element are bent inside said holders and are clamped in said bent condition.

6. A device as claimed in claim 5, wherein said at least one support element comprises a cable made from a number of twisted or bunched individual metal wires.

7. A device as claimed in claim 6, wherein the cable is plastic coated.

8. A device as claimed in claim 7, wherein the plastic coating penetrates into a center of the cable between the individual metal wires.

9. A device as claimed in claim 6, wherein said at least one holding element comprises a plurality of holding elements that are separated by small tubes surrounding said at least one support element.

10. A device as claimed in claim 9, wherein said small tubes are made of wound steel wires having an external protective sheath.

11. A device as claimed in claim 9, wherein at least said small tubes at the ends of said at least one support element adjacent to said holders are made of wound steel wires having an external protective sheath.

12. A device as claimed in claim 6, wherein said at least one holding element is at least partially made of ceramic.

13. A device as claimed in claim 6, wherein said at least one holding element is at least partially made of a highly abrasion-resistant plastic.

14. A device as claimed in claim 6, wherein said at least one support element is prestressed.

15. A device as claimed in claim 14, wherein the prestressing of said at least one support element is performed with a tensioning system having at least one linear compressed air cylinder.

16. A device as claimed in claim 14, wherein said at least one support element comprises a plurality of support elements, and wherein the prestressing of each one of said plurality of support elements is performed with a tensioning system having a plurality of linear compressed air cylinders, wherein one linear compressed air cylinder is provided for each support element.

17. A device as claimed in claim 1, wherein said at least one support element comprises a plurality of support elements, and wherein at least one spacer ring is provided for spacing said support elements.

18. A device as claimed in claim 1, wherein:

said at least one support element comprises a plurality of support elements;

said at least one holding element comprises a plurality of holding elements; and wherein 60% to 80% of said holding elements are spacer rings for spacing said support elements.

19. A device as claimed in claim 1, wherein ends of said at least one support element are bent inside said holders and are clamped in said bent condition.

20. A device as claimed in claim 1, wherein said at least one support element comprises a cable made from a number of twisted or bunched individual metal wires.

21. A device as claimed in claim 20, wherein the cable is plastic coated, and wherein the plastic coating penetrates into a center of the cable between the individual metal wires.

22. A device as claimed in claim 1, wherein said at least one holding element comprises a plurality of holding elements that are separated by small tubes surrounding said at least one support element.

23. A device as claimed in claim 22, wherein at least said small tubes at the ends of said at least one support element adjacent to said holders are made of wound steel wires having an external protective sheath.

24. A device as claimed in claim 1, wherein:

said at least one support element comprises a plurality of support elements;

wherein said plurality of support elements are prestressed; and wherein the prestressing of each one of said plurality of support elements is performed with a tensioning system having a plurality of linear compressed air cylinders, wherein one linear compressed air cylinder is provided for each support element.

* * * * *